US011427780B2

(12) United States Patent
Delbridge et al.

(10) Patent No.: US 11,427,780 B2
(45) Date of Patent: Aug. 30, 2022

(54) TOTAL BASE NUMBER BOOSTERS FOR MARINE DIESEL ENGINE LUBRICATING COMPOSITIONS

(71) Applicant: The Lubrizol Corporation, Wickliffe, OH (US)

(72) Inventors: Ewan E. Delbridge, Concord Township, OH (US); Binbin Guo, Sagamore Hills, OH (US); John K. Pudelski, Cleveland Heights, OH (US); John-Louis DiFlavio, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 16/330,943

(22) PCT Filed: Sep. 5, 2017

(86) PCT No.: PCT/US2017/050034

§ 371 (c)(1),
(2) Date: Mar. 6, 2019

(87) PCT Pub. No.: WO2018/048781

PCT Pub. Date: Mar. 15, 2018

(65) Prior Publication Data

US 2019/0249105 A1 Aug. 15, 2019

Related U.S. Application Data

(60) Provisional application No. 62/393,242, filed on Sep. 12, 2016.

(51) Int. Cl.

| | |
|---|---|
| ***C10M 141/06*** | (2006.01) |
| ***C10M 133/16*** | (2006.01) |
| *C10N 20/04* | (2006.01) |
| *C10N 30/02* | (2006.01) |
| *C10N 30/04* | (2006.01) |
| *C10N 30/10* | (2006.01) |
| *C10N 30/00* | (2006.01) |
| *C10N 40/04* | (2006.01) |
| *C10N 40/08* | (2006.01) |
| *C10N 40/25* | (2006.01) |
| *C10N 40/26* | (2006.01) |
| *C10N 60/14* | (2006.01) |

(52) U.S. Cl.

CPC ..... *C10M 141/06* (2013.01); *C10M 133/16* (2013.01); *C10M 2215/02* (2013.01); *C10M 2215/04* (2013.01); *C10M 2215/06* (2013.01); *C10M 2215/221* (2013.01); *C10M 2215/223* (2013.01); *C10M 2215/226* (2013.01); *C10M 2215/28* (2013.01); *C10N 2020/04* (2013.01); *C10N 2030/02* (2013.01); *C10N 2030/04* (2013.01); *C10N 2030/10* (2013.01); *C10N 2030/45* (2020.05); *C10N 2030/52* (2020.05); *C10N 2030/70* (2020.05); *C10N 2040/04* (2013.01); *C10N 2040/042* (2020.05); *C10N 2040/044* (2020.05); *C10N 2040/08* (2013.01); *C10N 2040/25* (2013.01); *C10N 2040/252* (2020.05); *C10N 2040/253* (2020.05); *C10N 2040/26* (2013.01); *C10N 2060/14* (2013.01)

(58) Field of Classification Search

CPC ..... C10M 2215/02; C10M 2215/04; C10M 2215/06; C10M 2215/221; C10M 2215/223; C10M 2215/226; C10M 2215/28; C10N 2220/021; C10N 2230/02; C10N 2230/04; C10N 2230/10; C10N 2230/45; C10N 2230/52; C10N 2230/70; C10N 2240/04; C10N 2240/042; C10N 2240/044; C10N 2240/08; C10N 2240/10; C10N 2240/102; C10N 2240/103; C10N 2240/105; C10N 2260/14; C10N 2030/52; C10N 2060/14

See application file for complete search history.

(56) References Cited

U.S. PATENT DOCUMENTS

| | | | |
|---|---|---|---|
| 3,172,892 | A | 3/1965 | Le Suer et al. |
| 3,197,405 | A | 7/1965 | Le Suer |
| 3,202,678 | A | 8/1965 | Stuart et al. |
| 3,216,936 | A | 11/1965 | Le Suer |
| 3,219,666 | A | 11/1965 | Norman et al. |
| 3,254,025 | A | 5/1966 | Le Suer |
| 3,272,746 | A | 9/1966 | Le Suer et al. |
| 3,316,177 | A | 4/1967 | Dorer, Jr. |
| 3,340,281 | A | 9/1967 | Brannen, Jr. |
| 3,351,552 | A | 11/1967 | Le Suer |
| 3,381,022 | A | 4/1968 | Le Suer |
| RE26,433 | E | 8/1968 | Le Suer |
| 3,433,744 | A | 3/1969 | Le Suer |
| 3,444,170 | A | 5/1969 | Norman et al. |
| 3,467,668 | A | 9/1969 | Gruber et al. |
| 3,501,405 | A | 3/1970 | Willette |
| 3,542,680 | A | 11/1970 | Le Suer |
| 3,576,743 | A | 4/1971 | Widmer et al. |
| 3,632,511 | A | 1/1972 | Liao |
| 4,234,435 | A | 11/1980 | Meinhardt et al. |
| 4,613,341 | A | 9/1986 | Zaweski et al. |
| 5,575,823 | A | 11/1996 | Wallace et al. |

(Continued)

FOREIGN PATENT DOCUMENTS

| | | | |
|---|---|---|---|
| CN | 101389739 | A | 3/2009 |
| CN | 102428164 | A | 4/2012 |

(Continued)

*Primary Examiner* — Vishal V Vasisth

(74) *Attorney, Agent, or Firm* — Fay Sharpe LLP; Ann M. Skerry

(57) ABSTRACT

A lubricating composition includes an oil of lubricating viscosity and a low-ash additive system including a low molecular weight amine with a Total Base Number of at least 150, and an N-substituted hydrocarbyl-substituted succinimide dispersant. The low-ash additive system provides the lubricating composition with a significant boost in TBN without substantially lowering the flashpoint. The composition is particularly suited to use as a marine diesel engine lubricant.

21 Claims, No Drawings

(56) References Cited

U.S. PATENT DOCUMENTS

| | | | |
|---|---|---|---|
| 6,153,565 | A | 11/2000 | Skinner et al. |
| 6,165,235 | A | 12/2000 | Kolp et al. |
| 6,281,179 | B1 | 8/2001 | Skinner et al. |
| 6,329,327 | B1 | 12/2001 | Tanaka et al. |
| 6,429,178 | B1 | 8/2002 | Skinner et al. |
| 6,429,179 | B1 | 8/2002 | Skinner et al. |
| 6,770,605 | B1 | 8/2004 | Stachew et al. |
| 6,914,037 | B2 | 7/2005 | Gatto |
| 7,238,650 | B2 | 7/2007 | Calder et al. |
| 7,285,516 | B2 | 10/2007 | Carrick et al. |
| 7,727,943 | B2 | 6/2010 | Brown et al. |
| 7,749,948 | B2 | 7/2010 | Bardasz |
| 8,633,141 | B2 | 1/2014 | Smith |
| 10,196,580 | B2 | 2/2019 | Zhang |
| 2005/0065045 | A1 | 3/2005 | Wilk et al. |
| 2005/0198894 | A1 | 9/2005 | Migdal et al. |
| 2006/0014651 | A1 | 1/2006 | Esche, Jr. et al. |
| 2006/0079413 | A1 | 4/2006 | Kocsis et al. |
| 2006/0183647 | A1 | 8/2006 | Kocsis et al. |
| 2008/0119378 | A1 | 5/2008 | Gandon et al. |
| 2008/0280795 | A1 | 11/2008 | Fujitsu et al. |
| 2009/0054278 | A1* | 2/2009 | Baumanis ..... C10M 169/045 508/158 |
| 2010/0016186 | A1* | 1/2010 | Smith ..... C10M 173/02 508/158 |
| 2010/0081592 | A1 | 4/2010 | Kocsis et al. |
| 2010/0160191 | A1* | 6/2010 | Butke ..... C10M 141/08 508/186 |
| 2010/0197536 | A1 | 8/2010 | Mosier et al. |
| 2011/0092403 | A1 | 4/2011 | Lancon et al. |
| 2012/0040876 | A1 | 2/2012 | Preston et al. |
| 2014/0041610 | A1 | 2/2014 | Lancon et al. |
| 2014/0162923 | A1 | 6/2014 | Bera et al. |
| 2016/0289587 | A1 | 10/2016 | Desantis et al. |
| 2017/0313955 | A1 | 11/2017 | Doyen |
| 2018/0223216 | A1* | 8/2018 | Zhang ..... C10M 141/06 |

FOREIGN PATENT DOCUMENTS

| | | |
|---|---|---|
| EP | 0 355 895 A2 | 2/1990 |
| EP | 2 740 782 B1 | 8/2016 |
| WO | WO 2008/147704 | 12/2008 |
| WO | WO 2014/074335 A1 | 5/2014 |
| WO | WO 2015/066685 A1 | 5/2015 |
| WO | WO 2016/033397 A1 | 3/2016 |
| WO | WO 2016/066517 A | 5/2016 |

* cited by examiner

TOTAL BASE NUMBER BOOSTERS FOR MARINE DIESEL ENGINE LUBRICATING COMPOSITIONS

This application claims the priority of International Application PCT/US2017/050034; filed Sep. 5, 2017, and U.S. Provisional Application Ser. No. 62/393,242, filed Sep. 12, 2016, from which the PCT application claims priority, the disclosures of which are incorporated herein in their entireties by reference.

BACKGROUND

The invention relates generally to lubricating compositions (lubricants) suited to use in marine diesel engines and finds particular application in connection with an additive system for boosting the total base number (TBN) of a marine diesel cylinder lubricant and to a lubricating method.

Marine diesel fuels used in low-speed two-stroke engines often contain a large amount of sulfur. The high-sulfur containing diesel fuels produce acidic combustion products, particularly sulfurous and sulfuric acids. These products can be neutralized using marine diesel cylinder lubricants (MDCLs) having a high base content. There are two measures of basicity that are commonly used in the field of lubricant additives: Total Base Number (TBN), as measured by ASTM D2896, is a titration that measures both strong and weak bases, while ASTM D4739 (BN) is a titration that measures strong bases but does not readily titrate weak bases, such as certain amines. TBN and BN are both expressed as an equivalent in milligrams of potash per gram of oil (mg of KOH/g).

Additives that are commonly used to boost the TBN in MDCL engine oils include detergents that are overbased by insoluble metallic salts, such as calcium or magnesium salts. These yield the corresponding metal carbonate as the lubricant is burned in the engine, which is neutralized by the acidic combustion products. However, if a low sulfur fuel is used, some of the metal carbonate is not neutralized and can be deposited on pistons and other engine components, causing wear over time.

One way to address this problem is to use different lubricants depending on the type of fuel being used. The sulfur level allowed in marine fuels in international waters is much higher than that allowed in some coastal areas (referred to as Environmental Control Areas). Therefore, an MDCL with a high TBN level can be used in international waters, while for coastal and inland waters, a low TBN level MDCL is used. However, it can be uneconomic or impractical to carry two MDCLs with different TBN levels.

Another way to address this problem is to use ashless (i.e., low-ash) compounds as TBN-boosting additives. The following relate generally to low-ash additives for lubricants: U.S. Pub. No. 20120040876, published Feb. 16, 2012, entitled ANTHRANILIC ESTERS AS ADDITIVES IN LUBRICANTS, by Preston, et al., discloses ester additives. U.S. Pub. No. 20110092403, published Apr. 21, 2011, and U.S. Pub. No. 20140041610, published Feb. 13, 2014, both entitled CYLINDER LUBRICANT FOR A TWO-STROKE MARINE ENGINE, by Lancon, et al., disclose oil-soluble fatty amines. WO2014074335, entitled BASIC ASHLESS ADDITIVES, discloses N-hydrocarbyl-substituted γ-aminoesters and aminothioesters. However, although these additives are able to boost the TBN of the lubricating composition, the amounts needed to provide the lubricating composition with the desired basicity can be relatively high.

As a result, they can negatively impact other performance requirements of the lubricating composition, such as viscosity.

Since the MDCL is passed through the cylinder only once, it should also have the ability to neutralize the acidic combustion products quickly. It should also have a relatively high flashpoint.

There remains a need for a low-ash additive system which boosts the TBN of an MDCL substantially, while enabling fast neutralization of combustion products.

BRIEF DESCRIPTION

In accordance with one aspect of the exemplary embodiment, a lubricating composition includes an oil of lubricating viscosity and a low-ash additive system including an amine with a Total Base Number, as determined by ASTM D2896-15, of at least 150, and an N-substituted hydrocarbyl-substituted succinimide dispersant.

The succinimide dispersant may have a Total Base Number, as determined by ASTM D2896-15, of at least 15, or at least 40, or at least 60, or at least 100, or at least 120.

The succinimide dispersant may provide at least 5 mg KOH/g, or at least 10 mg KOH/g, or at least 15 mg KOH/g of the Total Base Number of the lubricating composition, as determined by ASTM D2896-15.

The succinimide dispersant may have an N:CO ratio of at least 0.7, or at least 0.9, or at least 1.1, or at least 1.5, or at least 1.7.

The succinimide dispersant may be borated.

The amine may have a Total Base Number, as determined by ASTM D2896-15, of at least 200, or at least 300.

The amine may provide at least 5 mg KOH/g, or at least 10 mg KOH/g, or at least 20 mg KOH/g, or at least 30 mg KOH/g of the Total Base Number of the lubricating composition, as determined by ASTM D2896-15.

The low-ash additive system may have a Total Base Number, as determined by ASTM D2896-15, of at least 150 mg KOH/g, or at least 200 mg KOH/g.

The amine may have a weight average molecular weight of at least 50, or at least 100, or up to 600.

In the lubricating composition, a ratio, by weight, of the amine to the succinimide dispersant may be at least 20:80, or up to 90:10, or at least 30:70, or at least 40:60, or at least 50:50, and/or up to 80:20.

The low-ash additive system may be up to 10 wt. %, of the lubricating composition, or up to 5 wt. % of the lubricating composition, and/or at least 0.5 wt. of the lubricating composition.

The amine may have a closed cup flashpoint, as determined by ASTM D93-16, of at least 30° C., or at least 50° C.

The low-ash additive system has a closed cup flashpoint, as determined by ASTM D93-16, of at least 180° C., or at least 160° C. The flashpoint of the composition may decrease by no more than 20° C. per 1 mg KOH/g boost in total base number by the amine.

The amine may be selected from the group consisting of cyclic (poly)amines, branched aliphatic (poly)amines, aromatic (poly)amines, and mixtures thereof.

The amine may have a ratio of nitrogen atoms to the molecular weight of the amine of at least 0.0039.

The amine may be selected from the group consisting of N-methylmorpholine, 2-ethyl-1-hexylamine, tri-n-butylamine, N,N'-dimorpholinomethane, N-ethylmorpholine N,N,N',N",N"-pentamethyldiethylenetriamine, bis(1,2,2,6,6-pentamethyl-4-piperidyl) sebacate, and N,N-bis(2-ethylhexyl)-1,2,4-triazol-1-ylmethanamine, and mixtures thereof.

A Total Base Number of the lubricating composition may be at least 15 mg KOH/gm, or at least 25 mg KOH/gm, or at least 50 mg KOH/gm, or at least 60 mg KOH/gm, and/or up to 70 mg KOH/gm, as determined by ASTM D2896-15.

The low-ash additive system may provide at least 20%, or at least 25% of the Total Base Number of the lubricating composition, as determined by ASTM D2896-15.

The low-ash additive system may provide no more than 70%, or no more than 60%, of the Total Base Number of the lubricating composition, as determined by ASTM D2896-15.

The oil of lubricating viscosity may be at least 5 wt. %, or at least 10 wt. %, or at least 20 wt. %, or at least 30 wt. %, or at least 40 wt. %, or at least 60 wt. % of the lubricating composition.

The lubricating composition may further include at least one of an overbased detergent, a viscosity modifier, a friction modifier, and an antioxidant.

In one aspect, a method of lubricating an engine may include administering, to the engine, an effective amount of the lubricating composition.

The engine may be a 2-stroke marine diesel engine.

One aspect includes a use of the lubricating composition for lubricating an engine.

In accordance with one aspect of the exemplary embodiment, a method of increasing the Total Base Number of a lubricating composition which comprises adding, to the lubricating composition, an effective amount of a low-ash additive system including an amine with a Total Base Number, as determined by ASTM D2896-15, of at least 150 and an N-substituted hydrocarbyl-substituted succinimide dispersant, the low-ash additive system being in an amount sufficient to increase the Total Base Number of the a lubricating composition by at least 10%.

DETAILED DESCRIPTION

Aspects of the exemplary embodiment relate to a low-ash additive system suited to use as a TBN-booster in a lubricating composition and to a method and use of the lubricating composition. The additive system consists of an N-substituted hydrocarbyl-substituted succinimide dispersant (NSHS) and a low molecular weight amine (LMA).

The following definitions are used herein:

Total Base Number (TBN) is measured according to ASTM D2896-15, Standard Test Method for Base Number of Petroleum Products by Potentiometric Perchloric Acid Titration, ASTM International, West Conshohocken, Pa., 2015, DOI: 10.1520/D2896-15.

Base Number (BN) is measured according to ASTM D4739-11, Standard Test Method for Base Number Determination by Potentiometric Hydrochloric Acid Titration, ASTM International, West Conshohocken, Pa., 2011, DOI: 10.1520/D4739-11.

Nitrogen content of the lubricating composition is determined according to ASTM D4629-12, "Standard Test Method for Trace Nitrogen in Liquid Petroleum Hydrocarbons by Syringe/Inlet Oxidative Combustion and Chemiluminescence Detection," ASTM International, West Conshohocken, Pa., 2011, DOI: 10.1520/D4629-12.

Nitrogen content of the NSHS and low ash additive system is measured according to ASTM D5291-10 (2015), "Standard Test Methods for Instrumental Determination of Carbon, Hydrogen, and Nitrogen in Petroleum Products and Lubricants," ASTM International, West Conshohocken, Pa., 2015, DOI: 10.1520/D5291-10R15.

The NICO ratio of a compound is the ratio of the number of atoms of nitrogen (as measured by ASTM D5291-10) to the succinated polymer carbonyl groups, often measured as the acid value (TAN) or saponification (SAP) number of the succinated polymer; total acid number TAN is measured herein by ASTM D664-11a, "Standard Test Method for Acid Number of Petroleum Products by Potentiometric Titration," ASTM International, West Conshohocken, Pa., 2011, and SAP number is measured by ASTM D94-7(2012)e1, "Standard Test Methods for Saponification Number of Petroleum Products," ASTM International, West Conshohocken, Pa., 2012.

Closed-Cup Flashpoint of the LMA or low-ash additive system is measured according to ASTM D93-16, "Standard Test Methods for Flash Point by Pensky-Martens Closed Cup Tester," ASTM International, West Conshohocken, Pa., 2016, DOI: 10.1520/D0093-16.

Kinematic viscosity at 100° C. (KV_100) or at 40° C. (KV_40) is measured according to ASTM D445-15a, "Standard Test Method for Kinematic Viscosity of Transparent and Opaque Liquids (and Calculation of Dynamic Viscosity)," ASTM International, West Conshohocken, Pa., 2015, DOI: 10.1520/D0445-15A.

Sulfated ash content is measured according to ASTM D874-13a, Standard Test Method for Sulfated Ash from Lubricating Oils and Additives," ASTM International, West Conshohocken, Pa., 2013, DOI: 10.1520/D0874.

The molecular weight of low-molecular weight amines is expressed as molar mass ($g \cdot mol^{-1}$). The molecular weight of the N-substituted hydrocarbyl-substituted succinimide dispersant (NSHS) is determined by gel permeation chromatography.

The exemplary lubricating composition is able to cope with varying fuel sulfur levels. In particular, the exemplary low-ash additive system serves as an ashless TBN booster.

The exemplary low-ash additive system can also have a high acid neutralization rate, making it particularly suited to marine diesel applications. The additive system can be used in the lubricating composition at a low treat rate due to its combined TBN boosting efficiency. The low-ash additive system is able to increase TBN of the lubricating composition while also providing a good BN. In various aspects, the low-ash additive system can boost the TBN of an engine oil (or a lubricating composition without the low-ash additive system) by at least 5, or at least 10, or at least 20, or at least 30, or at least 40, or at least 50 mg of KOH/g, and in some embodiments, by up to 60 or up to 55 mg of KOH/g. As an example, for a lubricating composition having a TBN of 70 mg of KOH/g, the TBN for a TBN-boosted lubricating composition, which is the same except for the low-ash additive system being present, may be about 100 mg of KOH/g. This can be achieved using the exemplary low-ash additive system at a treat rate of up to 15 wt. %, or up to 5 wt. %, based on the weight of the MDCL oil.

The Low-Ash Additive System

The low-ash additive system is generally employed as a minor component of the lubricating composition. The NSHS and LMA may be combined in a suitable ratio to form an additive system with a TBN of at least 140 mg of KOH/g, or at least 150 mg of KOH/g, or at least 200 mg of KOH/g, or at least 250 mg of KOH/g at least 300 mg of KOH/g. For example, a ratio of LMA:NSHS, by weight, may be from 20:80 to 90:10, such as at least 30:70, or at least 40:60, or at least 50:50, or up to 80:20.

The low-ash additive system may have a closed cup flashpoint, as determined by ASTM D93-16, of at least 60° C., or at least 100° C. In one embodiment, the low-ash additive system is such that the flashpoint of the lubricant composition decreases by no more than 20° C., or no more than 10° C., or no more than 5° C. per 1 mg KOH/g TBN Boost of the composition caused by the LMA, as compared to the flashpoint of the composition without the LMA.

The ash content of the low-ash additive system contributes a sulfated ash content of no more than about 0.1% ash to the lubricating composition, as determined by ASTM D874-13a.

The Low Molecular Weight Amine

Suitable amines useful as the LMA include mono-amines and polyamines (including diamines, triamines). Examples include:

1. Linear and branched $C_6$-$C_{24}$ acyclic and cyclic alkyl amines, such those of the general formula:

$$R^2R^1N-(CH_2)_n-NR^3)_m-R^4$$

where n and m are independently at least 1, or at least 2, except where the compound is a cyclic structure, where n is at least 0, $R^1$, $R^2$, $R^3$, and $R^4$ are independently selected from H and alkyl groups, such as $C_1$-$C_{18}$ alkyl groups, or $C_1$-$C_8$ alkyl groups, or where $R^1$ and $R^4$ are bonded to form a cyclic structure. Examples of suitable alkyl groups include methyl, propyl, isopropyl, butyl, isobutyl, pentyl, isopentyl, neopentyl, hexyl, amyl, heptyl, octyl, iso-octyl, 2-ethylhexyl, nonyl, decyl, iso-decyl, undecyl, dodecyl, 2-propylheptyl, tridecyl, isotridecyl, tetradecyl, 4-methyl-2-pentyl, propyl heptyl, and combinations thereof.

Suitable polyamines of this type include aliphatic polyamines, such as polyethyleneimines, polypropyleneimines, polybutyleneimines, and polypentyleneimines, and heterocyclic polyalkylamines, such as piperazines and N-aminoalkyl-substituted piperazines.

Specific examples of poly(alkylamines) include ethylenediamine, diethylenetriamine (DETA), triethylenetetramine (TETA), tris-(2-aminoethyl)amine, propylenediamine, trimethylenediamine, tripropylenetetramine, tetraethylenepentamine, hexaethyleneheptamine, pentaethylenehexamine, and mixtures thereof. Particularly useful polyamines are linear ethylene polyamines with from 2-8 nitrogen groups.

2. N-alkylated morpholines, such as $C_1$-$C_3$ alkyl morpholines, and alkylene coupled morpholines, for example formaldehyde coupled morpholines.

In some embodiments, the LMA is fully saturated and is free of alkenyl groups.

The exemplary LMA has a TBN which is higher than that of the NSHS.

The LMA may have a TBN of at least 150 mg of KOH/g, or at least 200 mg of KOH/g, or at least 250 mg of KOH/g, or at least 300 mg of KOH/g, or at least 350 mg of KOH/g, or up to 500 mg of KOH/g. The LMA may have a molecular weight $M_w$ of at least 100 or at least 200, or up to 500, or up to 600.

A ratio of number of nitrogens to the molecular weight of the amine may be at least 0.0035, or at least 0.0039, or up to 0.02, or up to 0.018.

The LMA may have a minimum closed cup flash point, of at least 30° C.

The LMA may be a mixture of two or more low molecular weight amines.

Specific examples of LMAs include those listed in Table 1.

TABLE 1

Illustrative Low-molecular weight amines

| Amine | Structure | N/MW ratio |
|---|---|---|
| 2-ethyl-1-hexylamine (EHAM) | 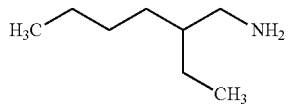 | 0.0077 |
| N,N,N',N'',N''-pentamethyldiethylenetriamine (PMDTA) | 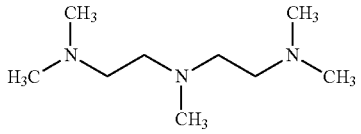 | 0.0173 |
| N-ethylmorpholine | 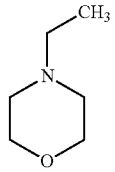 | 0.00868 |
| N-methylmorpholine | 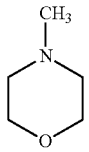 | 0.00989 |

TABLE 1-continued

| Illustrative Low-molecular weight amines | | |
|---|---|---|
| Amine | Structure | N/MW ratio |
| tri-n-butylamine | 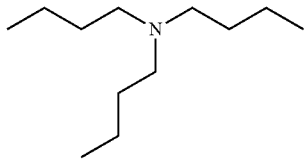 | 0.00539 |
| N,N'-dimorpholinomethane | 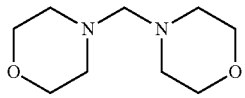 | 0.0107 |
| bis(1,2,2,6,6-pentamethyl-4-piperidyl) sebacate | 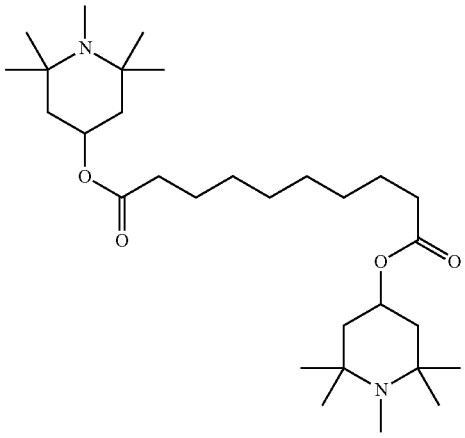 | 0.00394 |
| N,N-bis(2-ethylhexyl)-1,2,4-triazol-1-ylmethanamine. | 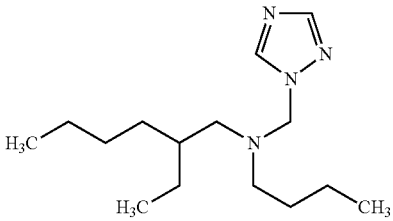 | 0.0120 |

Each of the amines in Table 1 is capable of delivering greater than 200 TBN by itself, and can be made compatible with marine diesel lubricating compositions by mixing with NSHS.

The N-Substituted Hydrocarbyl-Substituted Succinimide Dispersant

An N-substituted hydrocarbyl-substituted succinimide (NSHS) dispersant is one in which the nitrogen group in the 5-membered heterocyclic ring is substituted with a group other than hydrogen. The substituent group on the cyclic N may link the 5-membered heterocyclic ring to at least a second succinimide ring. The hydrocarbyl group is attached to one of the carbons of the heterocyclic ring of the succinimide, and may be a polyalkylene group, such as poly (isobutylene).

Example N-substituted hydrocarbyl-substituted succinimide dispersants useful as the NSHS include N-polyamine substituted polyalkenyl succinimides, such as N-substituted polyisobutylene succinimide. In particular embodiments, the polyolefin group includes a chain derived from at least 6, or at least 10, or at least 20, or up to 60, or up to 50, or up to 40, or up to 30 branched alkene units.

The polyalkenyl succinimide may be of the general form:

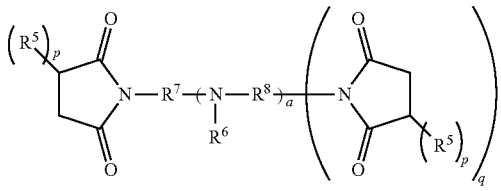

where a can be 0, 1 or more, such as up to 10, e.g., from 1-5, p indicates a chain of $R^5$ groups, where p can be at least 5, or at least 6, or up to 40, or up to 20, q can be 0, 1 or more, $R^6$ can be H or an alkyl group of 1-6 carbon atoms or an amine group, such as —$R^9NH_2$, where $R^9$ can be an alkyl group of 1-6 carbon atoms. For example $R^6$ is H or —$CH_2CH_2NH_2$, and $R^7$ and Ware independently an alkyl group of 1 to 6 carbon atoms.

Examples of alkyl groups suitable for $R^5$ include $C_3$-$C_{12}$ alkyl groups, such as propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, and eicosyl groups, and mixtures thereof. In one embodiment, $(R^5)_p$ is polyisobutylene.

Other N substituent groups useful herein are described, for example, in US 20100170829.

In one embodiment, the polyalkenyl succinimide is a polyisobutylene succinimide of the general form:

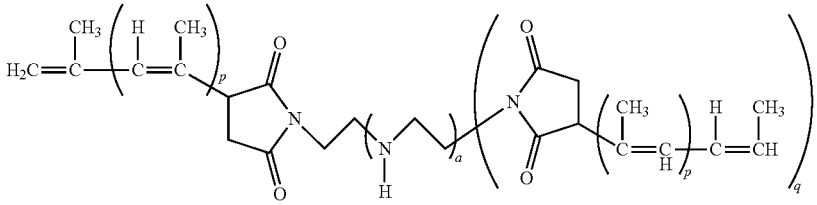

The polyisobutylene from which the NSHS is derived may have a number average molecular weight $M_n$ of at least 300, such as at least 500, or at least 800, such as up to 1500, or up to 2300. Succinimide dispersants and their preparation are disclosed, for example in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A. An example N-substituted polyisobutylene succinimide dispersant has a TBN of about 100-120 and a polyisobutylene tail of at least 800 $M_n$, such as at least 1000 $M_n$, or up to 2400 $M_n$, or up to 1200 $M_n$.

The NSHS may be the reaction product of a hydrocarbyl-substituted succinimide with a polyamine. The polyamine may be an alkylene polyamine containing at least one H—N< group or a condensate of (i) an alkylene polyamine containing at least one H—N< group with (ii) at least one alcohol containing at least one ether group, amine group, nitro group, or additional alcohol group. The reaction may be performed using the method described, for example, in U.S. Pat. No. 3,202,678 or 6,770,605. In one embodiment, a molar ratio of the hydrocarbyl-substituted succinimide to alkylene polyamine is no greater than 2:1, such as no greater than 1:5 to 1, and may be at least 0.8:1, such as about 1:1. In this way, the mono-succinimide is a major component of the resulting compound, with di-succinimide and poly succinimides together being a minor component. In one embodiment, the alkylene polyamine is an ethylene polyamine, such as tetraethylene pentamine.

The hydrocarbyl-substituted succinimide may be formed by reaction of a olefinically unsaturated hydrocarbon, or polymer thereof, such as polyisobutylene, of a desired molecular weight with maleic anhydride to form a hydrocarbyl-substituted succinic anhydride. Reaction temperatures of about 100° C. to about 250° C. can be used. This reaction can be promoted by the addition of chlorine. The hydrocarbyl-substituted succinic anhydride is reacted with ammonia to yield a hydrocarbyl-substituted succinimide. Alkenyl succinimides in which the succinic group contains a hydrocarbyl substituent containing at least 40 carbon atoms are described for example in U.S. Pat. Nos. 3,172,892; 3,202,678; 3,216,936; 3,219,666; 3,254,025; 3,272,746; 4,234,435; 4,613,341; and 5,575,823.

The exemplary NSHS may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described, for example, in U.S. Pub. No. 2009/0054278).

The N-substituted, hydrocarbyl-substituted succinimide dispersant (NSHS) may be a mixture of two or more N-substituted, hydrocarbyl-substituted succinimide dispersants.

The NSHS may have a TBN (on an oil-free basis) of at least 13 mg of KOH/g, or at least 25 mg of KOH/g, or at least 40 mg of KOH/g, or up to 140 mg of KOH/g. The NSHS may be present in sufficient amount to provide a TBN boost of at least 5 mg KOH/gm to an engine oil (or a lubricating composition without the NSHS), or at least 8 mg of KOH/g, or at least 15 mg of KOH/g, or up to 50 mg of KOH/g. The NSHS may have a N:CO ratio of at least 0.7, or at least 0.9, or at least 1.1, or at least 1.3, or at least 1.5, or at least 1.6, or at least 1.7, such as up to 2.2.

The NSHS may be a mixture of two or more N-substituted hydrocarbyl-substituted succinimide dispersant.

Lubricating Composition

The low-ash additive system may be present in the lubricating composition at a concentration of at least 0.5 wt. % and may be present at up to 20 wt. %. For example, the concentration of the additive system may be at least 1 wt. %, or at least 2 wt. %, or at least 3 wt. %, of the lubricating composition, such as up to 20 wt. %, or up to 10 wt. %, or up to 5 wt. %. The additive system may also be present in a concentrate, alone or with other additives and with a lesser amount of oil. In a concentrate, the amount of the additive system may be at least 2, or at least 3 times the concentration in the lubricating composition.

In addition to the additive system, the exemplary lubricating composition includes an oil of lubricating viscosity and optionally one or more additional performance additives suited to providing the performance properties of a fully formulated lubricating composition, e.g., a marine diesel cylinder lubricant. Examples of these additional performance additives include (overbased) detergents, viscosity modifiers, friction modifiers, antioxidants, dispersants, anti-wear/antiscuffing agents, metal deactivators, extreme pressure agents, foam inhibitors, demulsifiers, pour point depressants, corrosion inhibitors, seal swelling agents, and the like, which may be used singly or in combination.

Oil of Lubricating Viscosity

The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. % of the lubricating composition.

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/147704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content >0.03 wt. %, and/or <90 wt. % saturates, viscosity index 80-120); Group II (sulfur content ≤0.03 wt. %, and ≥90 wt. % saturates, viscosity index 80-120); Group III (sulfur content ≤0.03 wt. %, and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The oil of lubricating viscosity may have a kinematic viscosity (KV_100), determined according to ASTM D445-15a, of up to 30 $mm^2/s$ or up to 25 $mm^2/s$ (cSt) at 100° C. and can be at least 12 $mm^2/s$ at 100° C., and in other embodiments at least 15 $mm^2/s$.

The viscosity grade of cylinder oils suited to use in 2-stroke marine diesel engines may be from SAE-40 to SAE-60, which corresponds to a KV_100 of 12.5 to 26 $mm^2/s$. SAE-50 grade oils, for example, have a KV_100 of 16.3-21.9 $mm^2/s$. Cylinder oils for 2-stroke marine diesel engines may be formulated to achieve a KV_100 of 19 to 21.5 $mm^2/s$. This viscosity can be obtained by a mixture of additives and base oils, for example containing mineral bases of Group I such as Neutral Solvent (for example 500 NS or 600 NS) and Bright Stock bases. Any other combination of mineral or synthetic bases or bases of vegetable origin having, in mixture with the additives, a viscosity compatible with the grade SAE 50 can be used.

As an example, an oil formulation suited to use as a cylinder lubricant for low-speed 2-stroke marine diesel engines contains 18 to 25 wt. % of a Group I base oil of a BSS type (distillation residue, with a KV_100 of about 28-32 $mm^2/s$, with a density at 15° C. of 895-915 $kg/m^3$), and 50 to 60 wt. % of a Group I base oil of a SN 600 type (distillate, with a density at 15° C. of 880-900 $kg/m^3$, with a KV_100 of about 12 $mm^2/s$).

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, poly-acrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Synthetic ester base oils may be present in the lubricating composition of the invention in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rape oil, and soya oil.

The amount of the oil of lubricating viscosity present is typically the balance remaining after subtracting from 100 weight % the sum of the amount of the exemplary additive system and the other performance additives.

Detergents

The lubricating composition optionally further includes at least one detergent. Exemplary detergents useful herein include overbased metal-containing detergents. The metal of the metal-containing detergent may be zinc, sodium, calcium, barium, or magnesium. The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Example overbased metal-containing detergents include zinc, sodium, calcium and magnesium salts of sulfonates, phenates (including sulfur-containing and non-sulfur containing phenates), salixarates and salicylates. Such overbased sulfonates, salixarates, phenates and salicylates may have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

In one embodiment, the lubricating composition may be free of linear alkylbenzene sulfonate detergent. The sulfonate detergent may be a metal salt of one or more oil-soluble alkyl toluene sulfonate compounds as disclosed in U.S. Pub. No. 20080119378.

The lubricating composition may include at least 0.01 wt. % or at least 0.1 wt. %, detergent, and in some embodiments, up to 2 wt. %, or up to 1 wt. % detergent.

Antioxidants

The lubricating composition optionally further includes at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnapthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnapthylamines. Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

When present, the lubricating composition may include at least 0.1 wt. % or at least 0.5 wt. %, or at least 1 wt. % antioxidant, and in some embodiments, up to 3 wt. %, or up to 2.75 wt. %, or up to 2.5 wt. % antioxidant.

Dispersants

The lubricating composition optionally further includes at least one dispersant other than the exemplary NSHS. Exemplary dispersants include other succinimide dispersants, Mannich dispersants, succinamide dispersants, and polyolefin succinic acid esters, amides, and ester-amides, and mixtures thereof. The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetraethylenepentamine, pentaethylenehexamine, polyamine still bottoms, and mixtures thereof.

In one embodiment the dispersant may be a polyolefin succinic acid ester or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids, such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

When present, the lubricating composition may include at least 0.01 wt. %, or at least 0.1 wt. %, or at least 0.5 wt. %, or at least 1 wt. % of such other dispersants, and in some embodiments, up to 20 wt. %, or up to 15 wt. %, or up to 10 wt. %, or up to 6 wt. % or up to 3 wt. % dispersant.

Anti-wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

The lubricating composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof.

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

Oil-Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2-ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent.

Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyl disulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as di-hydrocarbon and tri-hydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt. %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, trialkyl phosphates, polyethylene glycols, polyethylene oxides, polypropylene oxides and (ethylene oxide-propylene oxide) polymers.

Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids. The friction modifier may be an ash-free friction modifier. Such friction modifiers are those which typically do not produce any sulfated ash when subjected to the conditions of ASTM D874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment, the ash-free friction modifier may be represented by the formula:

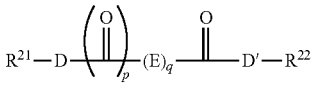

where, D and D' are independently selected from —O—, >NH, >$NR^{23}$, an imide group formed by taking together both D and D' groups and forming a $R^{21}$—N< group between two >C=O groups; E is selected from —$R^{24}$—O—$R^{25}$—, >$CH_2$, >$CHR^{26}$, >$CR^{26}R^{27}$, >C(OH)($CO_2R^{22}$), >$C(CO_2R^{22})_2$, and >$CHOR^{28}$; where $R^{24}$ and $R^{25}$ are independently selected from >$CH_2$, >$CHR^{26}$, >$CR^{26}R^{27}$, >C(OH)($CO_2R^{22}$), and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl) ester (i.e., di(2-ethylhexyl)tartrate), di($C_8$-$C_{10}$)tartrate, di($C_{12-15}$)tartrate, dioleyltartrate, oleyl tartrimide, and oleyl maleimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkylphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 percent by weight (or 0.12 to 1.2 or 0.15 to 0.8 percent by weight). The material may also be present in a concentrate, alone or with other additives and with a lesser amount of oil. In a concentrate, the amount of material may be two to ten times the above concentration amounts.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula:

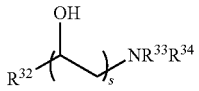

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-dodecyl(di)methylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, N-cocoyl methylamine, di-cocoylamine, bis(2-hexyldecyl)amine, bis(2-octyldodecyl) amine, bis(2-decyltetradecyl)amine, beef tallow dialkylamine, hardened beef tallow dialkylamine, and soybean oil dialkylamine; and trialk(en)ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal such as sodium and potassium, ammonium molybdates (e.g., $(NH_4)_2MoO_4$ or heptamolybdate $(NH_4)_6[Mo_7O_{24}].4H_2O$), $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates are often suitable because of their availability. In one embodiment, the lubricating composition comprises a molybdenum amine compound.

Other organomolybdenum compounds of the invention may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaminopropylamine, dodecylaminoethylamine, hexadecylaminopropylamine, hexadecylaminoethylamine, octadecylaminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen®C), N-tall oil alkyl-1,3-propanediamine (Duomeen®T) and N-oleyl-1,3-propanediamine (Duomeen®O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakura-lube® 710 available from Adeka which is a molybdenum amine compound, and Molyvan® 855, available from R.T. Vanderbilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

Demulsifiers

Demulsifiers useful herein include trialkyl phosphates, and various polymers and copolymers of ethylene glycol, ethylene oxide, propylene oxide, and mixtures thereof.

Seal Swell Agents

Seal swell agents useful herein include sulfolene derivatives such as Exxon Necton-37™ (FN 1380) and Exxon Mineral Seal Oil™ (FN 3200).

Example Lubricating Compositions

An engine lubricant in different embodiments may have a composition as illustrated in Table 2. All additives are expressed on an oil-free basis.

TABLE 2

Example Lubricating Compositions

| Additive | Embodiments (wt. %) A | B | C |
|---|---|---|---|
| Low-ash additive system | 5 to 50 | 10 to 40 | 15 to 30 |
| LMA | 5 to 35 | 10 to 25 | 15 to 20 |
| NSHS | 1 to 35 | 1 to 20 | 1 to 20 |
| Overbased Sulfonate Detergent | 2 to 30 | 5 to 20 | 8 to 15 |
| Phenol-based detergent | 0 to 12 | 0.1 to 10 | 1 to 5 |

TABLE 2-continued

Example Lubricating Compositions

| Additive | Embodiments (wt. %) A | B | C |
|---|---|---|---|
| Other (Borated) Dispersant | 0 to 12 | 0.5 to 8 | 1 to 5 |
| Antioxidant | 0 to 13 | 0.1 to 10 | 0.5 to 5 |
| Antiwear Agent | 0 to 15 | 0.1 to 10 | 0.3 to 5 |
| Corrosion Inhibitor | 0 to 2 | 0.1 to 1 | 0.2 to 0.5 |
| Friction Modifier | 0 to 6 | 0.05 to 4 | 0.1 to 2 |
| Viscosity Modifier | 0 to 10 | 0.5 to 8 | 1 to 6 |
| Other Performance Additives | 0 to 10 | 0 to 8 | 0 to 6 |
| Oil of Lubricating Viscosity | | Balance to 100 % | |

Use of the Lubricating Composition

The end use of the lubricating composition described herein includes use as a cylinder lubricant for an internal combustion engine, such as a 2-stroke marine diesel engine, but may also find use as an engine oil for passenger car, heavy, medium and light duty diesel vehicles, small engines such as motorcycle and 2-stroke oil engines, as a driveline lubricant, including gear and automatic transmission oils, and for other industrial oils, such as hydraulic lubricants.

An exemplary method of lubricating a mechanical device, such as a 2-stroke marine diesel engine cylinder, includes supplying the exemplary lubricating composition to the device.

Generally, the lubricating composition is added to the lubricating system of an internal combustion engine, which then delivers the lubricating composition to the cylinder of the engine, during its operation, where it may be combusted with the fuel.

The internal combustion engine may be a diesel-fueled engine, such as a 2-stroke marine diesel engine, or a gasoline-fueled engine, a natural gas-fueled engine, a mixed gasoline/alcohol-fueled engine, or a biodiesel-fueled engine. The internal combustion engine may be a 2-stroke or 4-stroke engine.

The lubricating composition may be suitable for use as a cylinder lubricant irrespective of the sulfur, phosphorus or sulfated ash (ASTM D874) content of the fuel. The sulfur content of the lubricating composition, which is particularly suited to use as an engine oil lubricant, may be 1 wt % or less, or 0.8 wt % or less, or 0.5 wt % or less, or 0.3 wt % or less. In one embodiment, the sulfur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment, the phosphorus content may be 100 ppm to 1000 ppm, or 200 ppm to 600 ppm. The total sulfated ash content may be 2 wt % or less, or 1.5 wt % or less, or 1.1 wt % or less, or 1 wt % or less, or 0.8 wt % or less, or 0.5 wt % or less, or 0.4 wt % or less. In one embodiment, the sulfated ash content may be 0.05 wt % to 0.9 wt %, or 0.1 wt % to 0.2 wt % or to 0.45 wt %.

Without intending to limit the scope of the exemplary embodiment, the following examples illustrate preparation and evaluation of example compounds.

EXAMPLES

Example 1: Evaluation of Lubricating Concentrates and Compositions

The low molecular weight amines shown in TABLE 3 were evaluated. When not measured, the TBN of the LMA was calculated by using the equivalent weight of the LMA. The equivalent weight of the LMA is the grams per mole of amine functional group.

TABLE 3

| Low Molecular Weight Amines (LMA) | | | | |
|---|---|---|---|---|
| LMA (Low Molecular Weight Amine) | Abbr. | TBN (D2896) | Mw | Closed-Cup Flashpoint (from SDS) |
| N-methylmorpholine | LMA-A | 555* | 101 | 13° C. |
| 2-ethyl-1-hexylamine | LMA-B | 402 | 129 | 45~55° C. |
| tri-n-butylamine | LMA-C | 302* | 185 | 75° C. |
| N,N'-Dimorpholinomethane | LMA-D | 586 | 186 | 85° C. |
| N-ethylmorpholine | LMA-E | 288 | 115 | 30° C. |
| N,N,N',N'',N''-pentamethyldiethylenetriamine (PMDTA) | LMA-F | 740 | 173 | 77° C. |
| Bis(1,2,2,6,6-pentamethyl-4-piperidyl) sebacate | LMA-G | 220* | 509 | 209° C. |
| N,N-Bis(2-ethylhexyl)-1,2,4-triazol-1-ylmethanamine | LMA-H | 348* | 323 | 210° C. |

*calculated based on equivalent weight

Lubricating concentrates are prepared as shown in Table 4 (amounts of additives are in weight percent on an oil-free basis). The LMA is blended with the NSHS (in all examples a 1000 $M_n$ Polyisobutylene succinimide) to make the low-ash additive system with a TBN of 300. The low-ash additive system is then combined with a marine diesel concentrate for forming a marine diesel cylinder lubricant (Table 5). The lubricating compositions are tested for compatibility, TBN, flash point, and the impact on viscosity.

TABLE 4

| Performance evaluation of low-ash additive systems | | | | | | | |
|---|---|---|---|---|---|---|---|
| | Baseline package (wt. %) | Amine + NSHS mix (wt. %) | Ratio of Amine: HSA | TBN D2896 | BN D4739 | KV_100 D445 | KV_40 D445 |
| Baseline system | | 0 | — | 330 | 333 | 108 | 1541 |
| System A (4-methyl morpholine) | | | | | | | |
| A1 | 21.4 | 5.0 | 50:50 | 308 | 313 | 75 | 924 |
| A2 | 16.8 | 10.0 | 50:50 | 294 | 303 | 42 | 362 |
| A3 | 15 | 15 | 50:50 | 264 | 301 | N.D. (volatile) | 205 |
| System B (2-ethyl-1-hexylamine) | | | | | | | |
| B1 | 21.4 | 5.0 | 60:40 | 317 | 312 | 40 | 388 |
| B2 | 16.8 | 10.0 | 60:40 | 310 | 306 | 19 | 120 |
| B3 | 15 | 15 | 60:40 | 304 | 293 | 13 | 67 |
| System C (Tri-n-butyl amine) | | | | | | | |
| C1 | 16.8 | 10 | 75:25 | 300 | 290 | 20 | 149 |
| C2 | 15 | 15 | 75:25 | 290 | 278 | 10 | 903 |
| System D (N,N'-Dimorpholinomethane) | | | | | | | |
| G1 | 21.4 | 5.0 | 50:50 | 330 | 316 | 110 | 1725 |
| G2 | 16.8 | 10.0 | 50:50 | 331 | 318 | 85 | 1311 |
| G3 | 15 | 15 | 50:50 | 332 | 309 | 74 | 1095 |
| System E (ethylmorpholine) | | | | | | | |
| E1 | 21.4 | 5.0 | 50:50 | 295 | 274 | 129 | 1440 |
| E2 | 16.8 | 10.0 | 50:50 | 247 | 292 | 70 | 628 |
| E3 | 15 | 15 | 50:50 | 229 | 209 | 44 | 319 |
| SYSTEM F (N,N,N',N'',N''-pentamethyldiethylenetriamine) | | | | | | | |
| F1 | 21.4 | 5.0 | 25:75 | 315 | 307 | 490 | 15240 |
| F2 | 16.8 | 10.0 | 25:75 | 235 | 261 | 294 | 6752 |
| F3 | 15 | 15 | 25:75 | 292 | 227 | 207 | 4233 |

TABLE 4-continued

| Performance evaluation of low-ash additive systems | | |
|---|---|---|
| | Closed-Cup Flashpoint D93 | Nitrogen content D5291 |
| Baseline system | 170 | 0.10 |
| System A (4-methyl morpholine) | | |
| A1 | 107 | 0.31 |
| A2 | 66 | 0.54 |
| A3 | 54 | 0.65 |
| System B (2-ethyl-1-hexylamine) | | |
| B1 | 112 | 0.36 |
| B2 | 86 | 0.62 |
| B3 | 79 | 0.78 |
| System C (Tri-n-butyl amine) | | |
| C1 | 106 | 0.55 |
| C2 | 102 | 0.75 |
| System D (N,N'-Dimorpholinomethane) | | |
| D1 | 110 | 1.86 |
| D2 | 103 | 3.59 |
| D3 | 96 | 4.68 |
| System E (N-ethylmorpholine) | | |
| E1 | 44 | 0.71 |
| E2 | 29 | 2.47 |
| E3 | 28 | 0.77 |
| SYSTEM F (N,N,N',N'',N''-pentamethyldiethylenetriamine) | | |
| F1 | 97 | 1.93 |
| F2 | 82 | 3.55 |
| F3 | 75 | 4.58 |

TABLE 5

| Lubricating Compositions | | | | | | | | | | | | |
|---|---|---|---|---|---|---|---|---|---|---|---|---|
| Ingredient | Additive System | | | | | | | | | | | |
| | REF1 | A1 | A2 | A3 | B1 | B2 | B3 | C1 | C2 | D1 | D2 | D3 |
| LMA-A | | 2.5 | 5.0 | 7.5 | | | | | | | | |
| LMA-B | | | | | 3.0 | 6.0 | 9.0 | | | | | |
| LMA-C | | | | | | | | 7.5 | 11.2 | | | |
| LMA-D | | | | | | | | | | 2.5 | 5.0 | 7.5 |
| NSHS | | 2.5 | 5.0 | 7.5 | 2.0 | 4.0 | 6.0 | 2.5 | 3.8 | 2.5 | 5.0 | 7.5 |
| MDCL Concentrate | 13.2 | 13.2 | 10.4 | 9.3 | 13.2 | 10.4 | 9.3 | 10.4 | 9.3 | 13.2 | 10.4 | 9.3 |
| SAE 50 Oil | | | | | | balance to 100 | | | | | | |

TABLE 5-continued

| Lubricating Compositions | | | | | | | | | | |
|---|---|---|---|---|---|---|---|---|---|---|
| Ingredient | Additive System | | | | | | | | | |
| | E1 | E2 | E3 | F1 | F2 | REF2 | G1 | G2 | H1 | H2 |
| LMA-E | 2.5 | 5.0 | 7.5 | | | | | | | |
| LMA-F | | | | 1.3 | 2.5 | | | | | |
| LMA-G | | | | | | | 4.8 | 14.1 | | |
| LMA-H | | | | | | | | | 2.7 | 10 |
| NSHS | 2.5 | 5.0 | 7.5 | 3.7 | 7.5 | | 0.5 | 1.6 | 0.7 | 2.5 |
| MDCL Concentrate | 13.2 | 10.4 | 9.3 | 13.2 | 10.4 | 18.9 | 11.4 | 13.2 | 11.4 | 13.2 |
| SAE 50 Oil | balance to 100 | | | | | | | | | |

Lubricating compositions are tested for compatibility, TBN, and flash point. The change in Pensky-Martens Closed Cup flash point (ΔPMCC) is calculated as the difference between the flash point of the example and the reference oil (REF1) as measured by ASTM D93. The change in TBN is calculated as the TBN of the example lubricant as measured by ASTM D2896, and the calculated TBN of MDCL concentrate alone. The change in flash point per change in TBN is shown in TABLE 6. It is desirable that the use of low molecular weight amines to boost TBN results in only modest decreases in the flashpoint of the finished lubricant.

Fluid compatibility was determined by visual analysis of the MDCL after a storage period of four weeks at two temperatures (room and 65° C.).

The MDCLs are tested for high temperature deposit forming tendency in a microcoker test (MCT) similar to GFC Lu-27-T-07. The MCT involves placing 0.6 $cm^3$ of the lubricating composition in the trough of an aluminum-alloy plate heated at one end (hot spot) and regulated at the other end (cold spot). At the end of the test, the deposit formation is determined and rated on a scale of 1-10 according to the CEC M-02-A-78 Code of Practice. Higher ratings indicate better deposit performance. Results are summarized in Table 7.

Oxidation resistance of the examples G2 and H2 was evaluated by Pressure Differential Scanning calorimetry (PDSC). The lubricants were heated to 215° C. (at a 40° C./min ramp and under air pressure of 590 kPa) and the time for oxidative induction (OIT) was recorded (Table 7).

TABLE 6

Physical Properties and Compatibility data for Example Compounds in Marine Diesel Formulation

| Lubricating Example | TBN D2896 | ΔPMCC D93 ΔTBN D2896 | % N D4629 | Fluid compatibility |
|---|---|---|---|---|
| REF1 | 71 | — | 0.05 | clear |
| A1 | 81 | −8 | 0.31 | clear |
| A2 | 73 | −7 | 0.54 | clear |
| A3 | 72 | −6 | 0.65 | clear |
| B1 | 85 | −6 | 0.36 | clear |
| B2 | 81 | −4 | 0.62 | clear |
| B3 | 83 | −3 | 0.78 | clear |
| C1 | 81 | −4 | 0.55 | clear |
| C2 | 87 | −3 | 0.75 | clear |
| D1 | 87 | −3 | 0.43 | clear |
| D2 | 94 | −2 | 0.71 | clear |
| D3 | 98 | −1 | no data | clear |
| E1 | 75 | −20 | 0.34 | clear |
| E2 | 58 | −41 | 0.66 | clear |
| E3 | 61 | −11 | 0.72 | clear |
| F1 | 77 | −14 | 0.62 | clear |
| F2 | 67 | −10 | 0.62 | clear |

TABLE 6-continued

Physical Properties and Compatibility data for Example Compounds in Marine Diesel Formulation

| Lubricating Example | TBN D2896 | ΔPMCC D93 ΔTBN D2896 | % N D4629 | Fluid compatibility |
|---|---|---|---|---|
| G1 | 71 | −1 | no data | clear |
| H1 | 72 | −2 | no data | clear |

TABLE 7

Performance evaluation selected low-ash additive systems

| Lubricating Example | TBN D2896 | KV100 | Oxidation resistance | MCT | Fluid compatibility |
|---|---|---|---|---|---|
| REF2 | 104 | 19 | 97 | 9.1 | Clear |
| G2 | 104 | 22 | >240 | 7.5 | Clear |
| H2 | 111 | 18 | 64 | 7.7 | Clear |

The examples above serve to demonstrate that the ashless delivery system can increase the TBN of the example lubricating composition while preserving compatibility of all the components. Specific examples G2 and H2 demonstrate additional performance benefits of these ashless systems.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

The singular forms "a," "an," and "the" include plural referents unless the context clearly dictates otherwise.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon. Hydrocarbylene groups are the bivalent equivalents of hydrocarbyl groups, i.e., are attached at each end to two parts of the remainder of the molecule.

Examples of hydrocarbyl groups include:

(i) hydrocarbon substituents, that is, aliphatic (e.g., alkyl or alkenyl), alicyclic (e.g., cycloalkyl, cycloalkenyl) substituents, aryl, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups useful as hydrocarbyl groups may include at least 1, or at least 2, or at least 3, or at least 4 carbon atoms, and in some embodiments, up to 8, or up to 10, or up to 12, or up to 14, or up to 16, or up to 18 carbon atoms. Illustrative examples include methyl, ethyl, propyl, butyl, pentyl, hexyl, heptyl, octyl, 2-ethylhexyl, nonyl, decyl, undecyl, dodecyl, tridecyl, tetradecyl, hexadecyl, stearyl, icosyl, docosyl, tetracosyl, 2-butyloctyl, 2-butyldecyl, 2-hexyloctyl, 2-hexydecyl, 2-octyldecyl, 2-hexyldodecyl, 2-octyldodecyl, 2-decyltetradecyl, 2-dodecylhexadecyl, 2-hexyldecyloctyldecyl, 2-tetradecyloctyldecyl, 4-methyl-2-pentyl, 2-propylheptyl, monomethyl branched-isostearyl, isomers thereof, mixtures thereof, and the like.

Representative alkenyl groups useful as hydrocarbyl groups include $C_2$-$C_{18}$ alkenyl groups, such as ethynyl, 2-propenyl, 1-methylene ethyl, 2-butenyl, 3-butenyl, pentenyl, hexenyl, heptenyl, octenyl, 2-ethylhexenyl, nonenyl, decenyl, undecenyl, dodecenyl, tridecenyl, tetradecenyl, hexadecenyl, isomers thereof, mixtures thereof, and the like.

Representative alicyclic groups useful as hydrocarbyl groups include cyclobutyl, cyclopentyl, and cyclohexyl groups.

Representative aryl groups include phenyl, toluyl, xylyl, cumenyl, mesityl, benzyl, phenethyl, styryl, cinnamyl, benzhydryl, trityl, ethylphenyl, propylphenyl, butylphenyl, pentylphenyl, hexylphenyl, heptylphenyl, octylphenyl, nonylphenyl, decylphenyl, undecylphenyl, dodecylphenyl, benzylphenyl, styrenated phenyl, p-cumylphenyl, α-naphthyl, β-naphthyl groups, and mixtures thereof.

Representative heteroatoms include sulfur, oxygen, nitrogen, and encompass substituents, such as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

Numerical values in the specification and claims of this application should be understood to include numerical values which are the same when reduced to the same number of significant figures and numerical values which differ from the stated value by less than the experimental error of conventional measurement technique of the type described in the present application to determine the value.

As used herein, the term "comprising" is inclusive and does not exclude additional, un-recited elements or method steps. However, in each recitation of "comprising" herein, it is intended that the term also encompasses, as alternative embodiments, the phrases "consisting essentially of" and "consisting of," where "consisting of" excludes any element or steps not specified and "consisting essentially of" permits the inclusion of additional un-recited elements or steps that do not materially affect the basic and novel, and essential characteristics of the composition or method under consideration.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricating composition comprising:

an oil of lubricating viscosity;

2-30 wt. % of an overbased metal-containing detergent having a Total Base Number, as determined by ASTM D2896-15, of 120 to 700; and no more than 40 wt. % of a low-ash additive system with a Total Base Number, as determined by ASTM D2896-15, of at least 140 mg of KOH/g consisting of:

an amine with a Total Base Number, as determined by ASTM D2896-15, of at least 150, the amine being selected from the group consisting of N-methylmorpholine, 2-ethyl-1-hexylamine, tri-n-butylamine, N,N'-dimorpholinomethane, N-ethylmorpholine N,N,N',N",N"-pentamethyldiethylenetriamine, bis (1,2,2,6,6-pentamethyl-4-piperidyl) sebacate, N,N-bis(2-ethylhexyl)-1,2,4-triazol-1-ylmethanamine, and mixtures thereof, the amine being at least 10 wt. % of the lubricating composition, and an N-substituted, hydrocarbyl-substituted, succinimide dispersant, present at 1 to 20 wt. % of the lubricating composition, and having a Total Base Number, as determined by ASTM D2896-15, of at least 60, wherein a nitrogen of a 5-membered, heterocyclic ring of the N-substituted, hydrocarbyl-substituted, succinimide dispersant is substituted with a group other than hydrogen and wherein the heterocyclic ring is hydrocarbyl-substituted, the low-ash additive system providing no more than 70% of the Total Base Number of the lubricating composition, as determined by ASTM D2896-15.

2. The lubricating composition of claim 1, wherein the N-substituted, hydrocarbyl-substituted, succinimide dispersant has a Total Base Number, as determined by ASTM D2896-15, of at least 100.

3. The lubricating composition of claim 1, wherein the N-substituted, hydrocarbyl-substituted, succinimide dispersant provides at least 5 mg KOH/g of the Total Base Number of the lubricating composition, as determined by ASTM D2896-15.

4. The lubricating composition of claim 1, wherein the N-substituted, hydrocarbyl-substituted, succinimide dispersant has an NICO ratio of at least 1.5.

5. The lubricating composition of claim 1, wherein the amine has a Total Base Number, as determined by ASTM D2896-15, of at least 200.

6. The lubricating composition of claim 1, wherein the amine provides at least 5 mg KOH/g of the Total Base Number of the lubricating composition, as determined by ASTM D2896-15.

7. The lubricating composition of claim 1, wherein the amine has a weight average molecular weight of at least 50.

8. The lubricating composition of claim 1, wherein the amine has a weight average molecular weight of no more than 600.

9. The lubricating composition of claim 1, wherein a ratio, by weight, of the amine to the N-substituted, hydrocarbyl-substituted, succinimide dispersant is at least 20:80.

10. The lubricating composition of claim 1, wherein the amine has a closed cup flashpoint, as determined by ASTM D93-16, of at least 209° C.

11. The lubricating composition of claim 1, wherein:

the N-substituted hydrocarbyl-substituted succinimide dispersant is of the form:

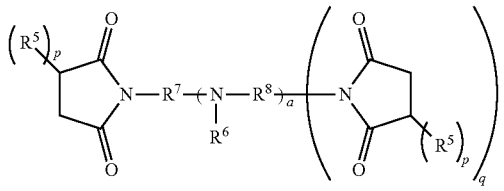

where a is 0 or more, each p indicates a chain of $R^5$ groups, where p is at least 5, and each $R^5$ is an alkylene group, q is 0 or more, $R^6$ is selected from H, an alkyl group of 1-6 carbon atoms, and an amine group of the form —$R^9NH_2$, where $R^9$ is an alkyl group of 1-6 carbon atoms, and $R^7$ and $R^8$ are independently an alkyl group of 1 to 6 carbon atoms.

12. The lubricating composition of claim 1, wherein the amine is selected from the group consisting of cyclic amines, cyclic polyamines, branched aliphatic amines, branched aliphatic polyamines, aromatic amines, aromatic polyamines, and mixtures thereof.

13. The lubricating composition of claim 1, wherein the amine has ratio of nitrogen atoms to molecular weight of at least 0.0039.

14. The lubricating composition of claim 1, wherein a ratio, by weight, of the amine to the N-substituted, hydrocarbyl-substituted, succinimide dispersant is at least 50:50.

15. The lubricating composition of claim 1, wherein a Total Base Number of the lubricating composition is at least 15 mg KOH/gm and/or up to 70 mg KOH/gm, as determined by ASTM D2896-15.

16. The lubricating composition according to claim 1, wherein the lubricating composition further comprises at least one of an overbased detergent, a viscosity modifier, a friction modifier, and an antioxidant.

17. The lubricating composition of claim 1, wherein the low-ash additive system has a Total Base Number, as determined by ASTM D2896-15, of at least 250 mg of KOH/g.

18. The lubricating composition of claim 1, wherein the amine is up to 25 wt. % of the lubricating composition.

19. A method of lubricating an engine, which comprises administering, to the engine, the lubricating composition according to claim 1.

20. A lubricating composition comprising:

an oil of lubricating viscosity; and no more than 40 wt. % of a low-ash additive system with a Total Base Number, as determined by ASTM D2896-15, of at least 140 mg of KOH/g consisting of:

an amine with a Total Base Number, as determined by ASTM D2896-15, of at least 150, wherein the amine is selected from the group consisting of bis(1,2,2,6,6-pentamethyl-4-piperidyl) sebacate, and N,N-bis(2-ethylhexyl)-1,2,4-triazol-1-ylmethanamine, and mixtures thereof, the amine being at least 10 wt. % of the lubricating composition; and an N-substituted, hydrocarbyl-substituted, succinimide dispersant, present at 1 to 20 wt. % of the lubricating composition, and having a Total Base Number, as determined by ASTM D2896-15, of at least 60, wherein a nitrogen of a 5-membered, heterocyclic ring of the N-substituted, hydrocarbyl-substituted, succinimide dispersant is substituted with a group other than hydrogen and wherein the heterocyclic ring is hydrocarbyl-substituted.

21. A method of increasing the Total Base Number of a lubricating composition which comprises adding, to the lubricating composition, a low-ash additive system consisting of:

an amine with a Total Base Number, as determined by ASTM D2896-15, of at least 150, the amine being at least 10 wt. % of the lubricating composition, the amine having a closed cup flashpoint, as determined by ASTM D93-16, of at least 209° C., the amine being at least 10 wt. % of the lubricating composition, and an optionally-borated N-substituted hydrocarbyl-substituted succinimide dispersant at 1 to 20 wt. % of the lubricating composition, the N-substituted hydrocarbyl-substituted succinimide dispersant being of the form:

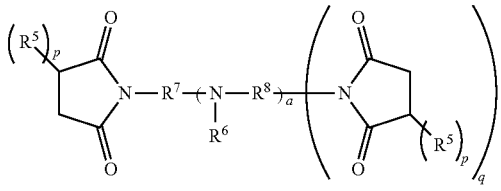

where a is 0 or more, p indicates a chain of $R^5$ groups, where p is at least 5 and each $R^5$ is an alkylene group, q is 0 or more, $R^6$ is selected from H, an alkyl group of 1-6 carbon atoms, and an amine group of the form —$R^9NH_2$, where $R^9$ is an alkyl group of 1-6 carbon atoms, and $R^7$ and $R^8$ are independently an alkyl group of 1 to 6 carbon atoms, in an amount sufficient to increase the Total Base Number of the lubricating composition by at least 10%, the low-ash additive system having a Total Base Number, as determined by ASTM D2896-15, of at least 200 mg KOH/g, the low-ash additive system providing no more than 60% of the Total Base Number of the lubricating composition, as determined by ASTM D2896-15.

* * * * *